US008661607B2

(12) United States Patent
Hwang et al.

(10) Patent No.: US 8,661,607 B2
(45) Date of Patent: Mar. 4, 2014

(54) VISUALIZATION DEVICE FOR DUST COLLECTION OF VACUUM CLEANER

(75) Inventors: Geunbae Hwang, Changwon-si (KR); Kyeongseon Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 75 days.

(21) Appl. No.: 13/378,630

(22) PCT Filed: Nov. 4, 2009

(86) PCT No.: PCT/KR2009/006458
§ 371 (c)(1),
(2), (4) Date: Dec. 15, 2011

(87) PCT Pub. No.: WO2011/055865
PCT Pub. Date: May 12, 2011

(65) Prior Publication Data
US 2012/0090127 A1 Apr. 19, 2012

(51) Int. Cl.
*A47L 7/00* (2006.01)
*A47L 9/10* (2006.01)

(52) U.S. Cl.
USPC ..... 15/339; 15/415.1; 15/347; 15/353

(58) Field of Classification Search
USPC ..... 15/347, 353, 339, 415.1
IPC ..... A47L 9/10,9/02, 7/00
See application file for complete search history.

(56) References Cited

U.S. PATENT DOCUMENTS 4,100,878 A * 7/1978 Leinfelt ..... 116/268
7,562,414 B2 * 7/2009 Oh et al. ..... 15/339
7,805,803 B2 * 10/2010 Andrup et al. ..... 15/339
7,987,550 B2 * 8/2011 Nielsen ..... 15/339
8,172,932 B2 * 5/2012 Oh et al. ..... 96/382

FOREIGN PATENT DOCUMENTS

JP 2005-168594 A 6/2005
JP 2005-237433 A 9/2005
JP 2007-044533 A 2/2007
KR 10-2007-0093850 A 9/2007

OTHER PUBLICATIONS

International Search Report issued in PCT Application No. PCT/KR09/006458 dated Jul. 28, 2010.

* cited by examiner

*Primary Examiner* — David Redding
(74) *Attorney, Agent, or Firm* — KED & Associates LLP

(57) ABSTRACT

The present invention comprises: a collecting section mounted at one side of the pathway, in which the suction force of a vacuum cleaner for sucking dust is transmitted, and moves at least some of the sucked dust towards one direction; a dust collecting section made of transparent material coupled with the collecting section, in which the receiving status of the inflow of dust through the collecting section is exposed to the outside; a discharge section which guides air and dust, which has passed through the dust collecting section, to be discharged into the pathway that transmits the suction force of a vacuum cleaner; and a foreign material discharge means which guides the flow of air into the inner corner of the dust collecting section by the operation of the user and forcibly discharges the remaining dust in the dust collection section to the outside. According to the present invention, the invention enables the user to check the status of the dust that is sucked and the convenient discharge of the dust collected in the inside of the collecting section.

10 Claims, 12 Drawing Sheets

VISUALIZATION DEVICE FOR DUST COLLECTION OF VACUUM CLEANER

TECHNICAL FIELD

The prevent disclosure relates to a visualization device for dust collection of a vacuum cleaner checking suction condition of a dust.

BACKGROUND

In general, the vacuum cleaner suctioning a dust and a foreign material along with air and filtering them at the inside of a body using a suction motor mounted at the inside of the body.

The vacuum cleaner having the same function as above includes a canister type in which a nozzle, that is, a suction port is communicated with the body through a connection tube, and a upright type in which the nozzle is formed integrally with the body.

Further, in the vacuum cleaner divided as above, the dust collecting device of a bag filter type or cyclone dust collecting type may be used to filter and store the dust and the foreign material among the air. However, most of the vacuum cleaner launched recently adapts the dust collecting device of cyclone dust collecting type due to reasons such as ease of use and maintenance costs.

On the other hand, if a user performs cleaning operations using the vacuum cleaner, when it is checked with eyes whether or not the dust is suctioned, the reliability of the performance of vacuum cleaner and the satisfaction for cleaning operations may be improved.

Thus, in the vacuum cleaner, the visualization device for dust collection showing the suction condition of the dust by the cleaning operation to the outside is required to meet the needs of the user as above.

SUMMARY

An object of the closure is to a visualization device for dust collection of a vacuum cleaner to enable a user to directly check a suction condition of the dust by collecting the portion of the dust suctioned during cleaning operations and exposing it to the outside.

Another object of the closure is to a visualization device for dust collection of a vacuum cleaner effectively discharging the collected dust to visualize the suction condition of the dust.

A visualization device for dust collection of a vacuum cleaner according to the closure, comprising: a collecting unit mounted in one side of transfer course of suction force suctioning a dust of the vacuum cleaner and moving at least portion of suctioned dust in one direction; a dust collecting unit, made of a transparent material, fastened to the collection unit and exposing the accommodating condition of the dust introduced through the collecting unit to the outside; a discharge unit guiding so that the air and the dust passing through the dust collecting unit are discharged into the transfer course of the suction force for the vacuum cleaner, and a foreign material discharge means forcibly discharging the dust remaining in the inside of the dust collecting unit into the outside by guiding the flowing of the air to the inside of the dust collecting unit by the operation of the user.

In the closure, when operating the vacuum cleaner, the user may easily check the suction condition of the dust to allow the suction condition of the dust to be exposed to the outside of the dust collecting unit made of the transparent material.

Further, the dust collecting unit is provided with the foreign material discharge means forcibly discharging the collected dust. When the user performs the pressing operation, the foreign material discharge means may effectively discharge the dust collected to the dust collecting unit by forcibly flowing outer air into the corner of the dust collecting unit.

DETAILED DESCRIPTION

Hereinafter, an exemplary embodiment of the closure will be described in detail with reference to drawings. However, the ideas of the closure is not limited to the presented embodiment and one skilled in the art understanding the ideas of the closure may easily propose another embodiment within the same range of the ideas.

Figure 1:
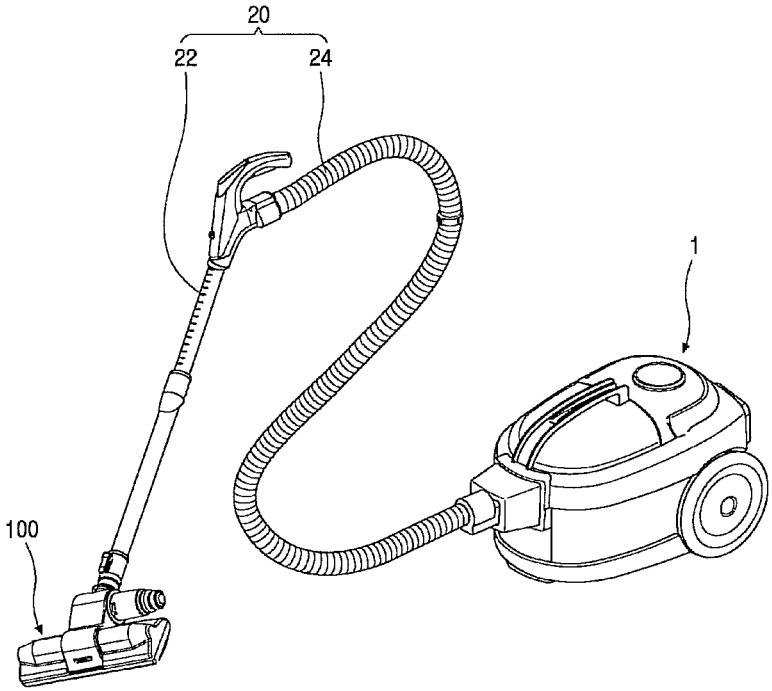
FIG. 1 shows a shape of a vacuum cleaner according to an exemplary embodiment of the disclosure.
Figure 2:
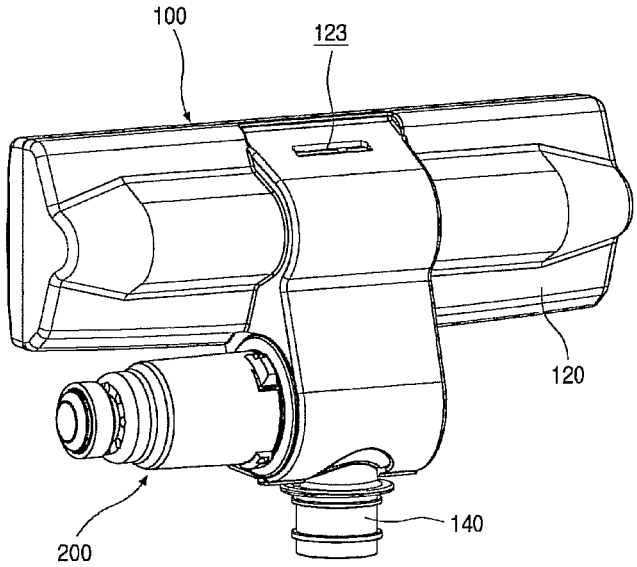
FIG. 2 shows a condition in which a visualization device for dust collection of a vacuum cleaner according to an exemplary embodiment of the disclosure is mounted in one side of a suction nozzle.
Figure 3:
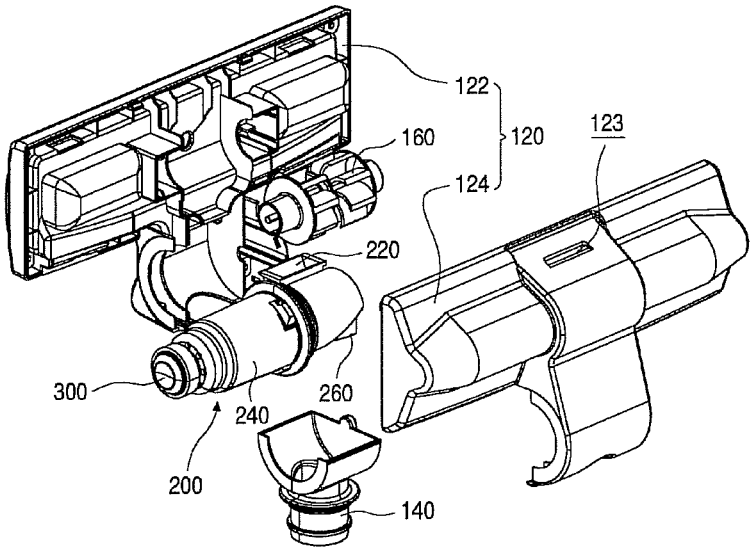
FIGS. 3 and 4 show a mounting structure for the visualization device for dust collection of the vacuum cleaner according to an exemplary embodiment of the disclosure.
Figure 4:
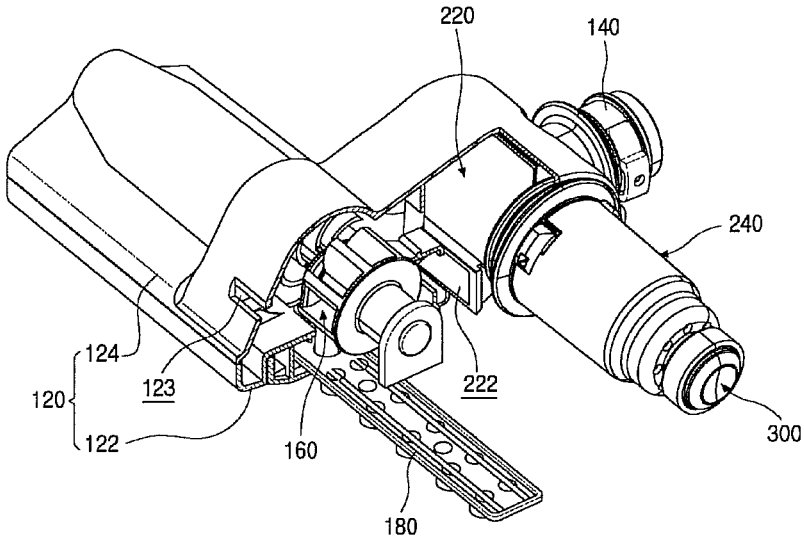

FIG. 1 shows a shape of a vacuum cleaner according to an exemplary embodiment of the disclosure, FIG. 2 shows a condition in which a visualization device for dust collection of a vacuum cleaner according to an exemplary embodiment of the disclosure is mounted in one side of a suction nozzle and FIGS. 3 and 4 show a mounting structure for the visualization device for dust collection of the vacuum cleaner according to an exemplary embodiment of the disclosure.

As shown in these drawings, a vacuum cleaner according to the disclosure includes a body 1 generating a suction force using a suction motor, a connection portion 20 transmitting the suction force generated by the body 1, and a suction nozzle 100 disposed at one side of the connection portion 20 and a suction nozzle sucking a foreign material scattered at a side to be cleaned, along an air.

The connection portion 20, in which the suction nozzle 100 is mounted at its one end, includes a length-adjustable extension tube 22, and a connection tube 24 made of a flexible material and connecting the extension tube 22 and the body 1 to each other.

The shape of the suction nozzle 100 is formed by a case 120 and the case 120 includes an upper case 124 and a lower case 122 to be coupled to each other.

Further, a connection portion 140 having a diameter corresponding to the diameter of the extension tube 22 so as to be infilled-mounted in the extension tube 22 is disposed at a lateral end of the upper case 124 and the lower case 122.

On the other hand, a visualization device for dust collection 200 visualizing a collecting condition of the foreign material in one side of a transmitting course of the suction force generated by the body 1 into the outside is disposed at one side of the case 120.

The visualization device for dust collection 200 according to an exemplary embodiment of the disclosure displays a accommodating condition of the dust to the outside by accommodating a portion of the air and the dust contained in the air collected through the suction nozzle 100 and shields the portion of the flowing course of the air moving into the body 1, disposed at a front of the connection portion 140.

Therefore, the portion of the air moving into the body 1 may be introduced into the inside of the visualization device for dust collection 200.

On the other hand, the suction nozzle 100 to be showed is infilled-mounted in the extension tube 22 to clean a bed linen such as a covers or a mattress or knitted goods with a number of fine hairs or fluffs such as a blanket or a carpet and includes a turbine 160 generating a vibration to the inside of the case 120, and a vibration frame 180 generating the vibration by a rotation of the turbine 160.

Further, an air inlet hole 123 introducing the outer air into a position corresponding to a mounting position of the turbine 160 is disposed at the upper case 124 so as to smoothly rotate the turbine 160.

Therefore, the turbine 160 rotates by using the air introduced into the air inlet hole 123 along the air introduced from the inlet (not shown) formed in a bottom of the suction nozzle 100.

Further, the turbine 160 is connected to the vibration frame 180 by using an eccentric cam and the vibration frame 180 connected to the turbine 160 vibrates when the turbine 160 rotates.

In addition, the mounting position of the turbine 160 is positioned at a front of the visualization device for dust collection 200, and the air forcibly flowed by the turbine 160 and the dust contained in the air may be easily introduced into the inside of the visualization device for dust collection 200.

Hereinafter, the visualization device for dust collection 200 having the mounting position mentioned above will be described with reference to drawings.

Figure 5:
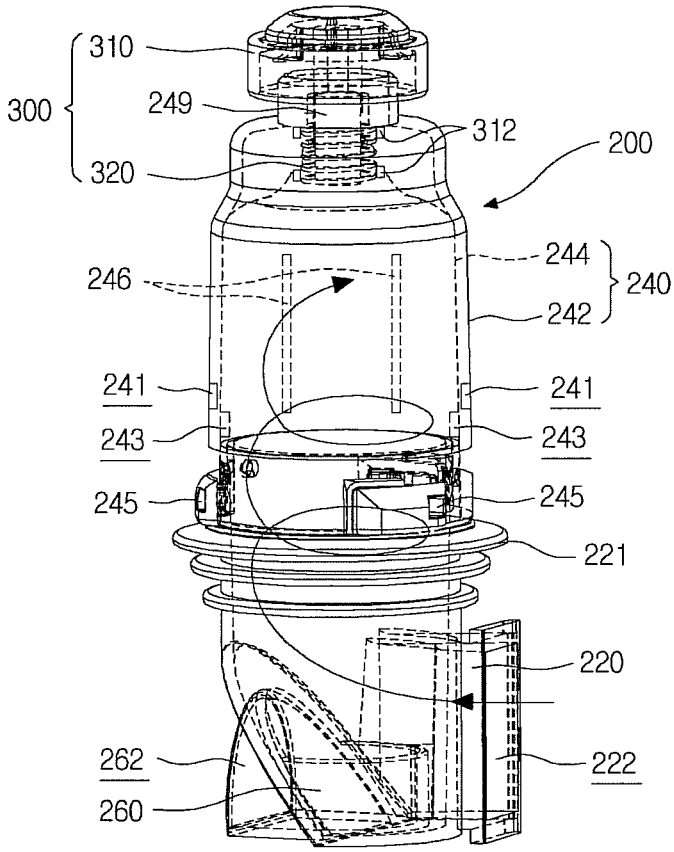
FIG. 5 shows a detailed configuration for the visualization device for dust collection of the vacuum cleaner according to an exemplary embodiment of the disclosure.
Figure 6:
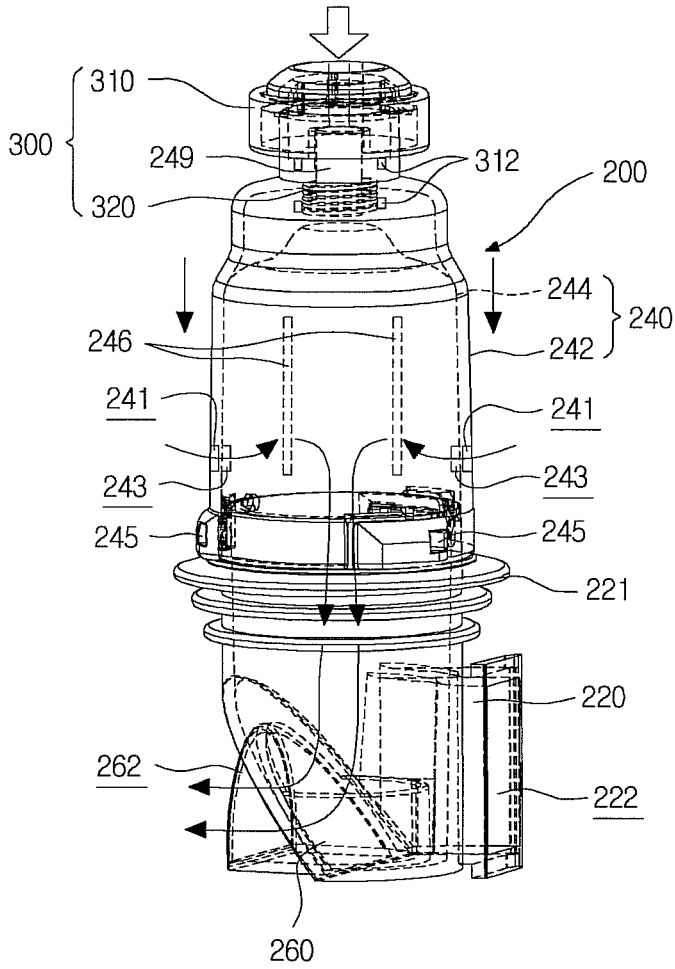
FIG. 6 shows the condition in which a push-button is pressed in the FIG. 5.

FIG. 5 shows a detailed configuration for the visualization device for dust collection of the vacuum cleaner according to an exemplary embodiment of the disclosure. FIG. 6 shows the condition in which a push-button is pressed in the FIG. 5.

As shown in these drawings, the visualization device for dust collection 200 of the vacuum cleaner according to an exemplary embodiment of the disclosure includes a collecting unit 220 guiding the introduction into the inside of the air and the dust, a dust collecting unit 240 extrinsically exposing the dust introduced through the collecting unit 220, a foreign material discharge means 300 removing the dust remaining in the dust collecting unit 240, and a discharge unit 260 communicated with the dust collecting unit 240 and guiding the discharge of the dust and the air.

In detail, the collecting unit 220 is formed by a cylindrical shape having an upper opening and is provided with a mounting projection 221 formed to be projected from the outside so that the air and the dust suctioned into the inside of the case 120 are not leaked into the mounting portion whiling maintaining a fixed position mounted in the case 120 at the top edge.

Further, the portion of the outside of the collecting unit 220 is formed to be projected toward the mounting position of the turbine 160, and the inlet 222 is disposed at the projection portion formed above so that the air and the dust are introduced into the inside of the collecting unit 220.

The inlet 222 is formed to guide the flowing of the air in the direction of the tangent line for the inside of the collecting unit 220, and the air introduced into the inside of the collecting unit 220 moves while rotating along with its inside.

One hand, the dust collecting unit 240 accommodating the air transferred while rotating through the inlet 222 and the dust contained in the transferred air is mounted in the top of the collecting unit 220.

The dust collecting unit 240 is made of a transparent material so that the accommodating condition of the dust may be exposed into the outside, and includes a second housing 244 directly fastened to the top of the collecting unit 220 and a first housing 242 sliding-movably provided to the outside of the second housing 244.

The second housing 244 is formed of shape of a Cup having a diameter slightly greater than the opened top of the collecting unit 220 and is configured to be fastened to top of the collecting unit 220 while rotating.

To this end, the fastening projection (not given reference numerals) projected from the outside of the collecting unit 220 is disposed at the top of the collecting unit 220. When the fastening projection is accommodated into the second housing 244 to rotate the second housing 244 or the collecting unit 220, a fastener 245 is further formed so that the fastening projection is inserted while moving toward one direction.

That is, the fastener 245 is projected from the outside of the second housing 244 to form a space to enable the fastening projection to insert and mount, and the collecting unit 220 may be coupled with the second housing 244 by inserting and mounting the fastening projection into the space.

Further, the rod 249 to be projected upward is disposed at the top side of the second housing 244. The description relating to the 249 will be described in more detail below.

The first housing 242 is formed of shape of a Cup surrounding the second housing 244, and is connected to the push-button 310 to be described below to allow the sliding to move toward a pressurization direction together with the push-button 310 when pressing the push-button.

To this end, a guide rib 246 is longitudinally formed on the inside of the first housing 242 in a sliding moving direction, a guide groove (not shown) at a position corresponding to the guide rib 246 is formed on the outside of the second housing 244. Meanwhile, the guide rib 246 is formed on the outside of the second housing 244, and it is possible to form the guide groove on the inside of the first housing 242.

Further, the center of the first housing 242 and the push-button 310 are punched to enable the rod (249) to pass. Therefore, the first housing 242 and the push-button 310 is able to slide downward without interference along with the rod 249 when pressurizing the push-button 310.

On the other hand, the dust transferred through the collecting unit 220 when operating the vacuum cleaner is stacked while rotating in the dust collecting unit 240 formed above.

Further, when the dust is stacked in the dust collecting unit 240, a user operates the foreign material discharge means 300 so as to discharge the dust.

The foreign material discharge means 300 forces the air to flow into the portion in which the dust is not easily discharged in the dust collecting unit 240, that is, the corner such as a contact portion between the second housing 244 and the collecting unit 220, thereby easily discharging the dust in the dust collecting unit 240.

To this end, first, the dust collecting unit 240 is formed with a second vent 243 punched near the top of the collecting unit 220 in the bottom of the second housing 244, and the second vent 243 is disposed so that the outer air is introduced into the inside of the second housing 244. Further, a first vent 241 punched at the position higher than the position of the second vent 243 is formed in the first housing 242, and the push-button 310 is disposed at the top of the first housing 242 so that first vent 241 and the second vent 243 may be selectively communicated to enable the external pressure to be transferred into the first housing 242.

Further, when an external pressure applied to the push-button 310 is released for the foreign material discharge means 300, the push-button 310 and the first housing 242 returns to its initial position. An elastic member 320 is inserted into the rod 249 to elastically support a space between the first housing 242 and the second housing 244 so that the outer air is not introduced into the inside of the second housing 244 through the first vent 241 and the second vent 243.

Therefore, when discharging the dust from the inside of the dust collecting unit 240, that is, the inside of the second housing 244, after the operation of the vacuum cleaner is stopped, the user presses the push-button 310. Then, when the first housing 242 is sliding-moving downward, the second vent 243 formed in the second housing 244 and the first vent 241 of the first housing 242 are communicated with each other, and the air is introduced into the inside of the second housing 244.

That is, when stopping the vacuum cleaner, there is some degree of vacuum pressure on the inside of the suction nozzle 100. when the first vent 241 and the second vent 243 are communicated with each other by pressing the push-button 310, the outer air is rapidly introduced into the inside of the second housing 244.

Further, the introduced air is introduced into the top of the collecting unit 220, that is, the inside of the second housing 244 and therefore, the dust remaining in the corner is removed by the introduced air. The removed air falls through opened top of the collecting unit 220.

On the other hand, the discharge unit 260 guiding the discharge of the air circulating the dust collecting unit 240 and a filth is also disposed at the bottom of the collecting unit 220.

As shown in FIG. 5, the discharge unit 260 is formed of shape of a fence projecting with a predetermined height from the bottom of the collecting unit 220 and includes the discharge port 262, in which one side of the discharge unit 260 is opened, discharging the air introduced into the discharge unit 260 into the outside of the collecting unit 220

On the other hand, the discharge unit 260 has a side with slant to be connected with the collecting unit 220 at the opened one side, is projected exteriorly with fixed length from the one surface of the slanted discharge unit 260 and includes the discharge port 262 opened from the projected portion to the slanted side (refer to FIG. 6).

Therefore, the air and the dust passing through the dust collecting unit 240 may be smoothly guided and discharged by the discharge unit 260 and the discharge port 262 formed at the same.

That is, when operating the vacuum cleaner, the portion of the air and the dust introduced through the suction nozzle 100 is introduced into the inside of the dust collecting unit 240 through the collecting unit 220, and the rotating condition of the dust introduced into the inside of the dust collecting unit 240 is exposed into the outside of the dust collecting unit 240.

The user checks the amount of dust exposed into the outside of the dust collecting unit 240, determines time empting the dust of the dust collecting unit 240, and presses the push-button 310 when empting the dust.

When the user presses the push-button 310, the push-button 310 and the first hosing 242 connected to the same move downward to allow the first vent 241 and the second vent 243 to position on the same line. Then, the second vent 243 is opened and the dust stacked at its inside is removed by introducing the outer air into the inside of the second hosing 244.

Further, when the user presses the push-button 310, the elastic member 320 is compressed. When the pressure applied to the push-button 310 is released, the push-button 310 and the first housing 242 move upward by the elastic member 320. Then, the second vent 243 that has been communicated is shielded.

On the other hand, a cone 270 (refer to FIG. 7) forming a cyclone flowing of the introduced air is also disposed at the inside of the visualization device for dust collecting 200 according to the closure.

Figure 7:
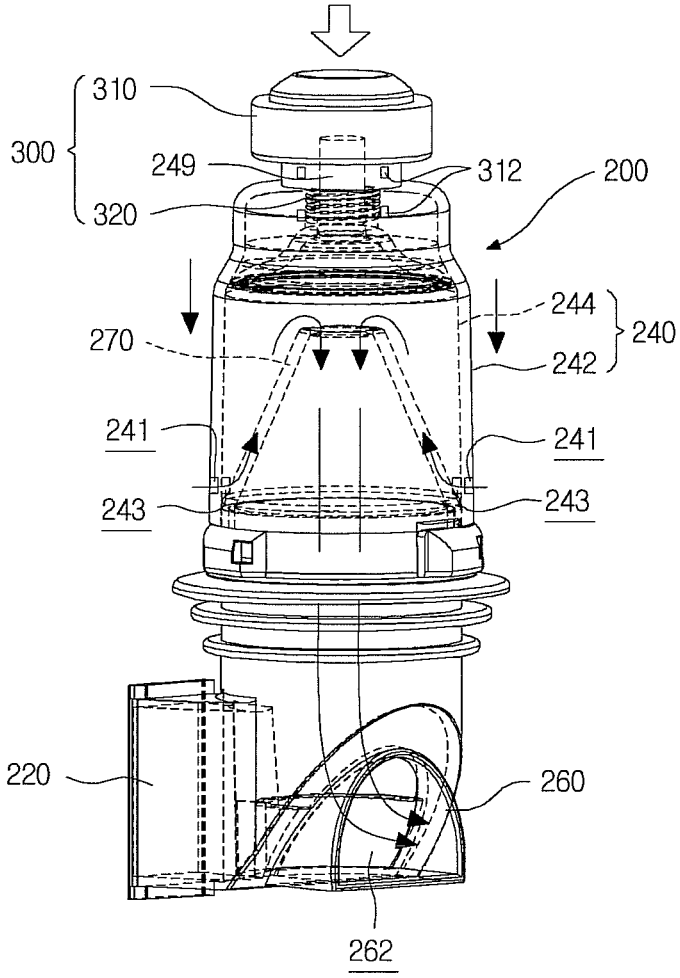
FIG. 7 shows the condition in which the dust of the inside of the visualization device for dust collection of the vacuum cleaner according to another embodiment of the disclosure is removed.

FIG. 7 shows the condition in which the dust of the inside of the visualization device for dust collection of the vacuum cleaner according to another embodiment of the disclosure is removed.

As shown, a cone 270 forming the cyclone flowing is also disposed at the top of the collecting unit 220 according to above-described embodiment of another embodiment of the disclosure.

In addition, the position of the second vent 243 formed in the second housing 244 is disposed at the bottom side of the cone 270 according to above-described embodiment and the first vent 241 of the first housing 242 is formed to be positioned at the position higher than the position of the second vent 243.

Since other remaining configuration is the same as the above-described embodiment, the detailed description will be omitted. When operating the vacuum cleaner according to another embodiment configured above, the rotation of the dust and the air introduced through the collecting unit 220 is more smoothly performed by the cone 270 to separate the dust among the air, thereby collecting the separated dust into the dust collecting unit, that is, the inside of the second housing 244.

If the user press the push-button 310 under the same condition as above, the first vent 241 moving downward by the pressure applied to the second vent 243 disposed at the bottom of the cone 270, and the push-button 310 is communicated to introduce the air. The introduced outer air transfers the dust along with the top of the cone 270 from the bottom of the cone 270 so as to discharge into the center of the cone 270, such that the dust of the inside of the dust collecting unit 240 is removed more efficiently.

On the other hand, the visualization device for dust collection 200 according to the disclosure may be configured as another type.

Figure 8:
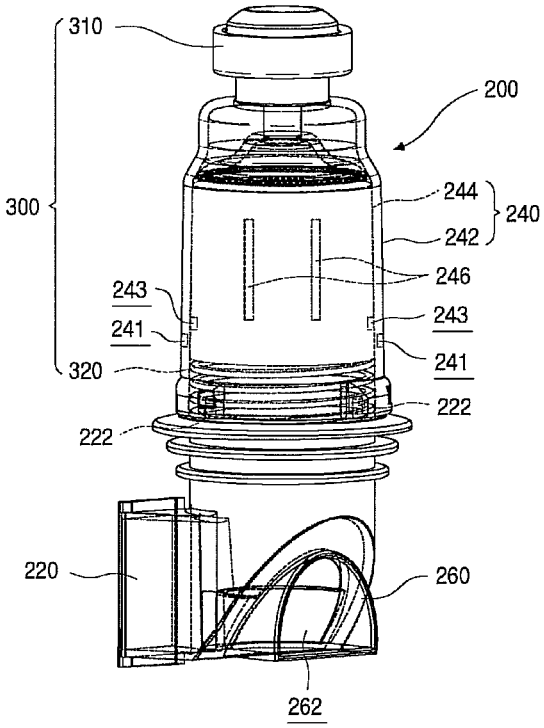
FIG. 8 shows a detailed configuration for the visualization device for dust collection of the vacuum cleaner according to another exemplary embodiment of the disclosure.
Figure 9:
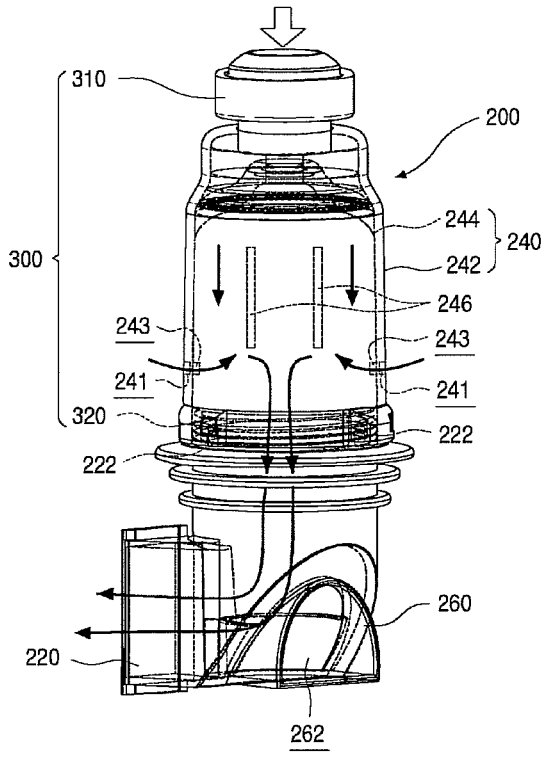
FIG. 9 shows the condition in which a push-button is pressed in the FIG. 8.

FIG. 8 shows a detailed configuration for the visualization device for dust collection of the vacuum cleaner according to an exemplary embodiment of the disclosure. FIG. 9 shows the condition that a push-button is pressed in the FIG. 8.

As shown in these drawings, the dust collecting unit 240 is configured as type different from above-described embodiment according to another embodiment of the disclosure.

In the dust collecting unit 240 according to another embodiment of the disclosure, the first housing 242 forming the shape is fastened to the collecting unit 220. Further, the second housing 244 is sliding-movably disposed vertically at the inside of the first housing 242 by the foreign material discharge means 300 to be described below and the outer air is introduced into the inside of the second housing 244 to discharge the collected dust.

In detail, the foreign material discharge means 300 includes the first vent 241 and the second vent 243 formed in the first housing 242 and the second housing 244, respectively, and the push-button 310 and the elastic member 320 sliding-moving the second housing 244 so that the first vent 241 and the second vent 243 are communicated with each other.

The first vent 241, formed in the first housing 242, is formed in the top of the collecting unit 220 and the portion in which the first housing 242 is fastened. In addition, the second vent 243, formed in the second housing 244, is formed in the position higher than the position of the first vent 241.

Further, the push-button 310 penetrates the top of the first housing 242 to contact the second housing 244. Therefore, when the user presses the push-button 310, the second housing 244 is pressurized by the push-button 310, thereby sliding-moving.

Further, the elastic member 320 is disposed at the bottom of the second housing 244 so that the second housing 244 moves downward by the push-button 310 and then may return to its initial position.

The elastic member 320 may be configured in a type of a pocket spring and a number of the elastic member 320 may be disposed to support at least two spots of the second housing 244.

On the other hand, although not shown, in another embodiment of the disclosure, the cone 270 shown in FIG. 7 is disposed at the top of the collecting unit 220, and the first vent 241 and the second vent 243 may be disposed at the bottom side of the cone 270.

Figure 10:
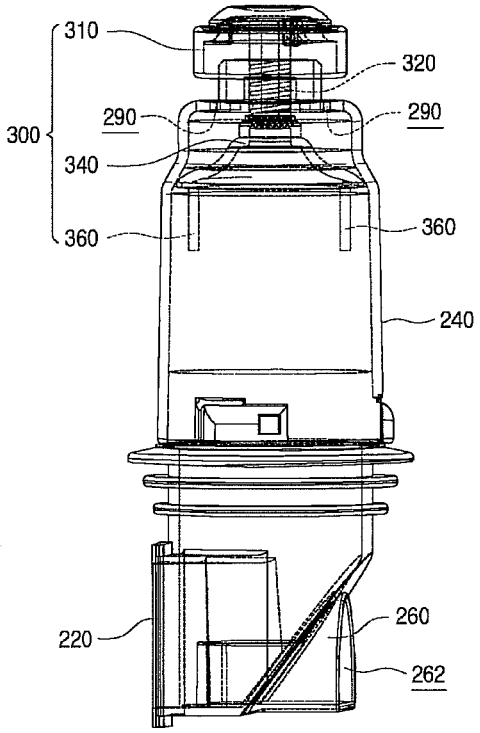
FIG. 10 shows a detailed configuration for the visualization device for dust collection of the vacuum cleaner according to another exemplary embodiment of the disclosure.
Figure 11:
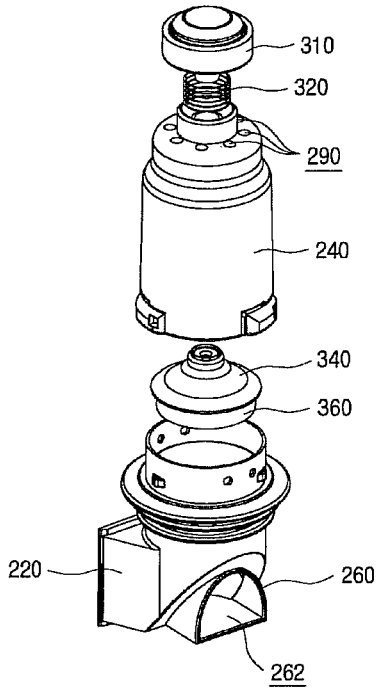
FIG. 11 is an exploded perspective view of FIG. 10.

FIG. 10 shows a detailed configuration for the visualization device for dust collection of the vacuum cleaner according to another exemplary embodiment of the disclosure and FIG. 11 is an exploded perspective view of FIG. 10.

As shown in these drawings, in another embodiment of the disclosure, the dust collecting unit 240 to be fastened to the collecting unit 220 is formed of a housing.

A number of a suction hole 290 are formed in the top of the dust collecting unit 240 so that the outer air may be introduced into the inside of the dust collecting unit 240.

The top of the dust collecting unit 240 has a diameter narrower than that of the bottom thereof, the top of the dust collecting unit 240 is selectively shielded by the foreign material discharge means 300 to be described below, and therefore, the introduction of the outer air discharging the dust into the inside of the dust collecting unit 240 may be performed if necessary.

The foreign material discharge means 300 includes the suction hole 290, a shield member 340 sliding-moving in the inside of the dust collecting unit 240 and shielding the top having narrow diameter of the dust collecting unit 240, the push-button 310 and the elastic member 320 sliding—moving the shield member 340, and a discharge guide 360 disposed at the bottom of the shield member 340 and guiding the flowing of the introduced air.

In detail, in the push-button 310, the top thereof is exposed to the outside of the dust collecting unit 240 and the portion of the bottom thereof is mounted to penetrate the center of the dust collecting unit 240 Further, the shield member 340 is mounted in the bottom of the push-button 310 positioned at the inside of the dust collecting unit 240 to be sled together with the push-button 310.

In addition, the elastic member 320 is disposed between the push-button 310 and the dust collecting unit 240 and elastically compressed when pressurizing the push-button. Then, the elastic member 320 is elastically restored when pressure-releasing to enable the push-button 310 to return to its initial position.

As shown, the diameter of the shield member 340 is smaller as it goes from the bottom thereof to the top thereof. The bottom thereof contacts the inside wall of the top of the dust collecting unit 240 to shield the suction hole 290

On the other hand, the discharge guide 360 is extended toward the bottom, that is, combination portion of the top of the collecting unit 220 and the dust collecting unit 240 to be lined up with the inside wall of the dust collecting unit 240 at the position slightly spaced inward from a edge of the shield member 340

Accordingly, when the push-button 310 is pressurized and the suction hole 290 is opened while sliding—moving the shield member 340, the outer air introduced through the suction hole 290 is guided to the space of the discharge guide 360 and the inside wall of the dust collecting unit 240 to be supplied toward the combination portion of the top of the collecting unit 220 and the dust collecting unit 240, thereby easily removing the dust positioned at the corner of the inside of the dust collecting unit 240.

On the other hand, a cone 270(refer to FIG. 12) forming a cyclone flowing is also disposed at the inside of the dust collecting unit 240 as above-described embodiment according to another embodiment of the disclosure configured as above.

Figure 12:
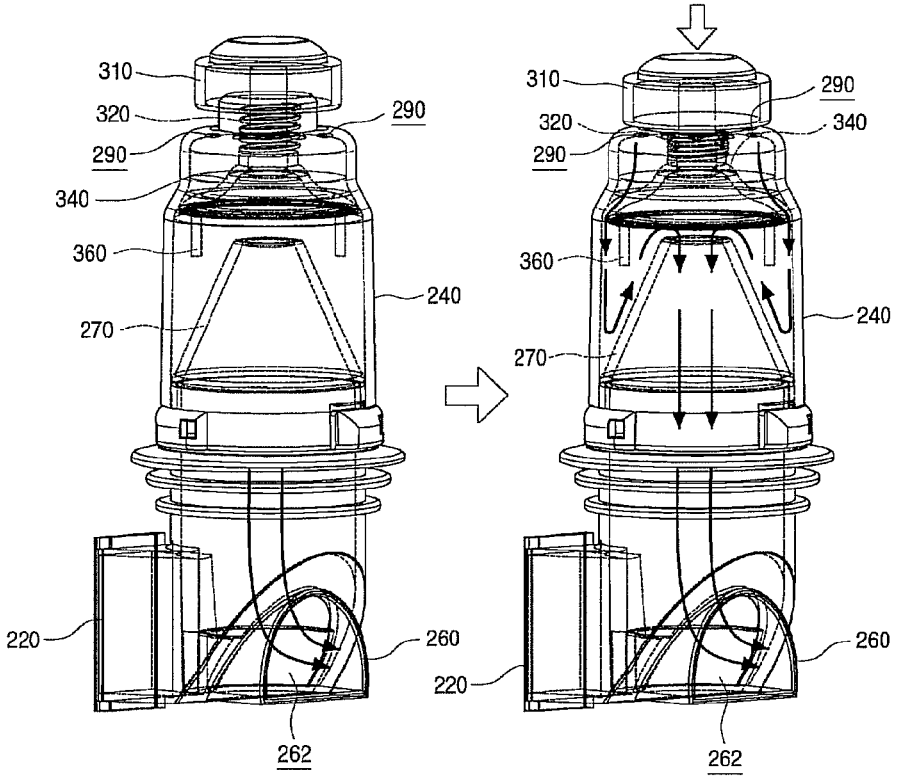
FIG. 12 shows the condition in which the dusts are discharged in another exemplary embodiment of the disclosure.

FIG. 12 shows the condition in which the dusts are discharged in another exemplary embodiment of the disclosure.

The configuration of FIG. 12 is the same configuration as the configuration of embodiment shown in FIG. 10 and FIG. 11 according to another embodiment of the disclosure but the cone 270 is further disposed at the inside of the dust collecting unit 240.

The dust and the air introduced through the collecting unit 220 is separated while being subjected to the cyclone flowing by the cone 270. the separated dust is collected into the inside of the dust collecting unit 240 and the collected dust is exposed to the outside through transparent dust collecting unit 240, such that the user may check the suction condition of the dust.

Further, when a great deal of dust is collected into the inside of the dust collecting unit 240, the user presses the push-button 310. At this time, the discharge guide 360 extended toward the bottom of the cone 270 from the one side of the shield member 340 guides the air introduced into the inside of the dust collecting unit 240 to the bottom of the cone 270, such that the air moves along with the outside from the bottom of the cone 270 to remove and discharge the dust (refer to drawing on the right of FIG. 12).

What is claimed is:

1. A suction nozzle for a vacuum cleaner, comprising:

a nozzle case having a suction inlet through which air and dust are introduced into the nozzle case;

a dust collection device mounted to the nozzle case, the dust collection device comprising a first housing having a first vent formed on the first housing to introduce outer air into the first housing, and a second housing having a second vent and being disposed outside of the first housing;

a guide device that guides the air and the dust to the dust collection device; and a push button to move one of the first housing or second housing such that the first and second vents communicate with one another.

2. The suction nozzle of claim 1, wherein the push button is connected to the first housing to move the first housing with respect to the second housing.

3. The suction nozzle of claim 2, wherein the first housing moves between a first position and a second position, and wherein the second vent is covered by the first housing when the first housing is located in the first position and the second vent communicates with the first vent when the first housing is located in the second position.

4. The suction nozzle of claim 3, further comprising an elastic member disposed between the first housing and the second housing to move the first housing from the first position to the second position.

5. The suction nozzle of claim 1, wherein the push button is connected to the second housing to move the second housing with respect to the first housing.

6. The suction nozzle of claim 5, wherein the second housing moves between a first position and a second position, and wherein the second vent is covered by the first housing when the second housing is located in the first position and the second vent communicates with the first vent when the second housing is located in the second position.

7. The suction nozzle of claim 5, further comprising an elastic member to move the second housing from the first position to the second position.

8. The suction nozzle of claim 1, further comprising a guiding rib formed on the first housing or the second housing so that at least one of the first housing or the second housing stably moves.

9. The suction nozzle of claim 1, wherein a cone is disposed in the second housing and separates foreign material within the air by cyclone-flowing the air.

10. The suction nozzle of claim 9, wherein the second vent is disposed between the first vent and the cone.

* * * * *